US010856591B2

(12) United States Patent
Tsaur et al.

(10) Patent No.: US 10,856,591 B2
(45) Date of Patent: Dec. 8, 2020

(54) BREATHABLE MASK CAPABLE OF TRANSMITTING SOUND

(71) Applicant: TO2M CORPORATION, Hsinchu (TW)

(72) Inventors: Garry Tsaur, Rowland Heights, CA (US); Frank Tsaur, Rowland Heights, CA (US); Ting-Hua Wang, Rowland Heights, CA (US); Nancy Tsaur, Rowland Heights, CA (US); Emily Tsaur, Rowland Heights, CA (US)

(73) Assignee: TO2M CORPORATION, Hsinchu (TW)

( * ) Notice: Subject to any disclaimer, the term of this patent is extended or adjusted under 35 U.S.C. 154(b) by 385 days.

(21) Appl. No.: 15/689,553

(22) Filed: Aug. 29, 2017

(65) Prior Publication Data

US 2019/0059470 A1 Feb. 28, 2019

(51) Int. Cl.

| | |
|---|---|
| ***A41D 13/11*** | (2006.01) |
| ***A62B 18/08*** | (2006.01) |
| ***A62B 23/02*** | (2006.01) |

(52) U.S. Cl.

CPC ..... *A41D 13/11* (2013.01); *A41D 13/1138* (2013.01); *A62B 18/08* (2013.01); *A62B 23/025* (2013.01)

(58) Field of Classification Search

CPC .. A41D 13/11; A41D 13/113; A41D 13/1146; A41D 13/1138; A41D 13/1107; A41D 13/1178; A41D 13/1115; A62B 18/08; A62B 23/025; G10K 11/24

See application file for complete search history.

(56) References Cited

U.S. PATENT DOCUMENTS

| | | | | |
|---|---|---|---|---|
| 3,216,415 | A * | 11/1965 | Littleton | A41D 13/11 128/206.17 |
| 5,620,545 | A * | 4/1997 | Braun | A62B 23/02 156/205 |
| 6,277,479 | B1 * | 8/2001 | Campbell | A61F 13/15203 428/213 |
| 6,462,253 | B1 * | 10/2002 | Magnusson | A61F 13/539 604/378 |
| 6,719,742 | B1 * | 4/2004 | McCormack | B32B 3/26 604/385.01 |

(Continued)

FOREIGN PATENT DOCUMENTS

TW M536070 U 2/2017

*Primary Examiner* — Samchuan C Yao
*Assistant Examiner* — Nathan M Le
(74) *Attorney, Agent, or Firm* — Muncy, Geissler, Olds & Lowe, P.C.

(57) ABSTRACT

Disclosed is a breathable mask capable of transmitting sound; the body of the mask comprises a breathable structure having a plurality of breathable holes and a sound transmission structure without the breathable holes; the sound transmission structure is prepared as follows: selecting a sound transmission area on the breathable mask and seal-pressing and hot-melting the inner and outer portion of the mask, then melting the plurality of breathable holes of the sound transmission area into a non-porous structure through the seal-pressing and hot-melting process; the breathable mask can further comprise a speaker edge, wherein the speaker edge is a circle non-porous structure outside the sound transmission structure, having an effect of expanding the sound.

5 Claims, 4 Drawing Sheets

(56) References Cited

U.S. PATENT DOCUMENTS

| | | | | |
|---|---|---|---|---|
| 2003/0113528 | A1* | 6/2003 | Moya | B01D 61/18 428/304.4 |
| 2005/0170726 | A1* | 8/2005 | Brunson | A41D 13/11 442/327 |
| 2006/0230485 | A1* | 10/2006 | Lee | A41D 13/1138 2/15 |
| 2010/0173070 | A1* | 7/2010 | Niu | B01D 39/083 427/215 |
| 2011/0067700 | A1* | 3/2011 | Spoo | A62B 23/025 128/206.19 |
| 2013/0186414 | A1* | 7/2013 | Suzuki | A41D 13/1161 128/863 |
| 2014/0041671 | A1* | 2/2014 | Kumar | A41D 13/1123 128/863 |
| 2015/0335080 | A1* | 11/2015 | Giles | A41D 13/1115 128/863 |
| 2016/0001109 | A1* | 1/2016 | Kanno | A62B 18/08 181/167 |
| 2016/0015098 | A1* | 1/2016 | Conlon | A62B 23/025 128/863 |
| 2016/0016021 | A1* | 1/2016 | Duffy | A41D 13/1161 128/863 |
| 2017/0175313 | A1* | 6/2017 | Song | D04H 1/46 |

* cited by examiner

BREATHABLE MASK CAPABLE OF TRANSMITTING SOUND

BACKGROUND OF THE INVENTION

1. Field of the Invention

The present invention relates to a breathable mask capable of transmitting sound, in which the sound can be clearly transmitted without removing the mask from the face.

2. Description of the Prior Art

Masks can prevent harmful substances from entering into the human body through respiration. With an increase in industrialization, air pollution has become more severe. Due to this reason, there is a significant amount of people wearing masks. During periods of influenza, most people will wear masks at all times, in order to avoid disease infection.

Although masks are capable of blocking harmful substances such as dirt, bacteria, virus, chemical gases, and pollen, their flaws are found within the porous fabrics that are used which allow air to pass in and out. These porous materials cause the human voice to sound weak, distorted and unclear.

Now the mobile phones have become increasingly common, the incidence where a person talks on the phone while wearing a mask increases as well. However, since sound is absorbed by the mask, the person is then required to remove the mask in order to discuss important issues, thereby compromising the original intent of mask protection.

Therefore designing a mask capable of transmitting sound, which can transmit clearly the voice in the case of wearing a mask, is an important function of masks for modern people.

TW M536070 is a previous creation of the inventor of the present invention. The creation relates to a mask provided with a sound transmittance structure, which can transmit the sound to the outside of the mask without the need of removing the mask. The mask comprises a mask body and a sound transmittance structure, wherein the mask body is arranged with holes; the sound transmittance structure comprises a sound film and the sound inside the mask may be clearly transmitted to the outside of the mask through the holes and the sound transmittance structure. Though the sound inside the mask is transmitted through a sound film in the prior art, there is the probability of non-closed seal so as to cause inefficient protective function of the mask and hence affect the sound transmission. Also, when using sticker adhesives to fix the sound film, it will diffuse a peculiar smell that is harmful for health due to the solvents therein. In addition, when adding an additional sound film, the cost of mask may be increased significantly.

Thus, the ability to design a mask capable of transmitting sound clearly, without a need for additional materials which may increase the cost, is an important subject to be addressed by the present invention herein.

SUMMARY OF THE INVENTION

The purpose of the present invention is to provide a breathable mask capable of transmitting sound; the body of the mask comprises a breathable structure having a plurality of breathable holes and a sound transmission structure without the breathable holes; the sound transmission structure is prepared as follows: selecting a sound transmission area on the breathable mask and seal-pressing and hot-melting both the inner and outer side of the mask, then melting the plurality of breathable holes of the sound transmission area into a non-porous structure through the seal-pressing and hot-melting process.

To achieve the above purpose of the invention, the length, width or diameter of the sound transmission area is 0.5~2 centimeter.

To achieve the above purpose of the invention, the breathable mask is a structure with one layer, two layers, three layers or more than three layers; wherein each layer is melted to bond mutually by the seal-pressing and hot-melting.

To achieve the above purpose of the invention, the material of the breathable mask is selected from an artificial fiber.

To achieve the above purpose of the invention, the artificial fiber is selected from a group consisting of PU (Polyurethanes), PE (Polyethylene), PET (polyethylene terephthalate), PP (Polypropylene), PB (Polybutene), and PS (Polystyrene).

To achieve the above purpose of the invention, a non-woven cloth with a designated color is added to any layer of the breathable mask and the designated color can be presented after this seal-pressing point is seal-pressed and hot-melted.

Another purpose of the present invention is to provide a breathable mask capable of transmitting sound with a sound expansion function; the body of the mask comprises a breathable structure having a plurality of breathable holes and a sound transmission structure without the breathable holes; the sound transmission structure is prepared as follows: selecting a sound transmission area on the breathable mask and seal-pressing and hot-melting both the inner and outer side of the mask, then melting the plurality of breathable holes of the sound transmission area into a non-porous structure through the seal-pressing and hot-melting process; the breathable mask can further comprise a speaker edge, wherein the speaker edge is a circle non-porous structure outside the sound transmission structure, having an effect of expanding the sound; wherein the speaker edge is prepared as follows: selecting a sound expansion area at a spaced-periphery of the sound transmission structure from the breathable mask, where the spaced-periphery is spaced apart from an outer boundary of the sound transmission structure; and then seal-pressing and hot-melting the inner and outer parts of the mask to melt the plurality of breathable holes of the sound transmission area into a non-porous structure; an annular section is formed between the outer boundary of the sound transmission structure and the speaker edge, wherein the annular section having the breathable structure with the plurality of breathable holes; wherein the number of the speaker edge is one or more than one.

To achieve the above purpose of the invention, the length, width or diameter of the sound transmission area is 0.5~2 centimeter, the length, width or diameter of the speaker edge is 0.6~3 centimeter.

To achieve the above purpose of the invention, the breathable mask is a structure with one layer, two layers, three layers or more than three layers; wherein each layer is melted to bond mutually by the seal-pressing and hot-melting.

To achieve the above purpose of the invention, the material of the breathable mask is selected from an artificial fiber.

To achieve the above purpose of the invention, wherein the artificial fiber is selected from a group consisting of PU (Polyurethanes), PE (Polyethylene), PET (polyethylene terephthalate), PP (Polypropylene), PB (Polybutene), and PS (Polystyrene).

To achieve the above purpose of the invention, a non-woven cloth with a designated color is added to any layer of the breathable mask and the designated color can be presented after this seal-pressing point is seal-pressed and hot-melted.

SYMBOL DESCRIPTION OF MAIN ELEMENT

Figure 1:
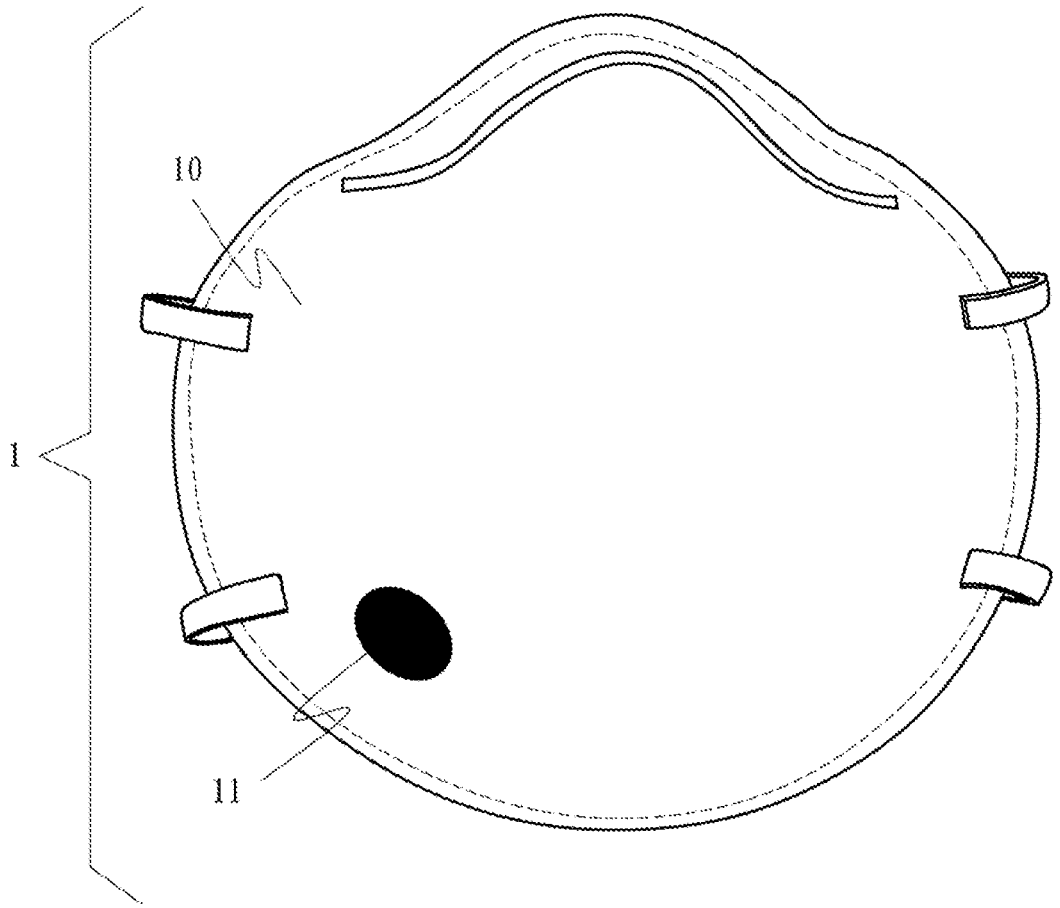
FIG. 1 is a view of a mask with sound transmission structure.

1 mask
10 mask body
11 sound transmission structure
101 internal mask layer
102 intermediate mask layer
103 external mask layer
12 speaker edge

DETAILED DESCRIPTION OF THE PREFERRED EMBODIMENT

The present invention is exemplarily illustrated by but not limited to following embodiments.

Embodiment 1

A Single Layer Mask with Sound Transmission Structure

As shown in FIG. 1, a mask (1) with a mask body (10) of single-layered non-woven cloth in PP (Polypropylene) fiber is taken to be seal-pressed with an ultrasonic sealing machine on the lower part more to the right of the mask. The tiny holes of PP fiber are seal-pressed and hot-melted at the seal-pressing point to mutually bond from dissolving due to the high temperature so as to form a sound transmission structure (11). The sound transmission structure (11) is a round with a diameter of 0.5~2 centimeter, and the seal-pressing point can be selected to appear transparent but the color thereof is not limited to a transparent color; apart from PP, the material of the mask can also be substituted by other artificial fibers such as PU (Polyurethanes), PE (Polyethylene), PET (polyethylene terephthalate), PP (Polypropylene), PB (Polybutene), and PS (Polystyrene).

Use effects of the mask: testing the sound transmission effect while wearing a mask; holding a mobile phone on the right hand and the sound can be clearly heard from the user through the phone, but the volume on the left where there is no sound film becomes smaller while the sound distortion exists. It can be known from the test that there are no tiny holes at the seal-pressing point the mask to absorb the sound, therefore the sound can be transmitted effectively.

Embodiment 2

A Mask with Colorful Sound Transmission Structure

A mask in PP fiber is added with a designated color on any layer in the middle of the mask, and then to be seal-pressed with an ultrasonic sealing machine on the lower part more to the right of the mask. The tiny holes of PP fiber are seal-pressed and hot-melted at the seal-pressing point to mutually bond from dissolving due to the high temperature so as to form a sound transmission structure. The sound transmission structure is a round with a diameter of 0.5~2 centimeter, and the PP material at the seal-pressing point appears transparent and manifests above designated color; apart from PP, the material of the mask can also be substituted by other artificial fibers such as PU (Polyurethanes), PE (Polyethylene), PET (polyethylene terephthalate), PP (Polypropylene), PB (Polybutene), and PS (Polystyrene).

Use effects of the mask: testing the sound transmission effect while wearing a mask; speaking through a mobile phone while wearing the mask and the sound can be clearly heard from the user through the phone, the seal-pressing point of the mask is to be known that there are no tiny holes to absorb the sound such that the sound can be effectively transmitted; furthermore, the designated color is presented at the seal-pressing point to help in distinguishing different uses, masks of different users and building an aesthetic appearance of the mask.

Embodiment 3

A Three Layer Mask with Sound Transmission Structure

Figure 2:
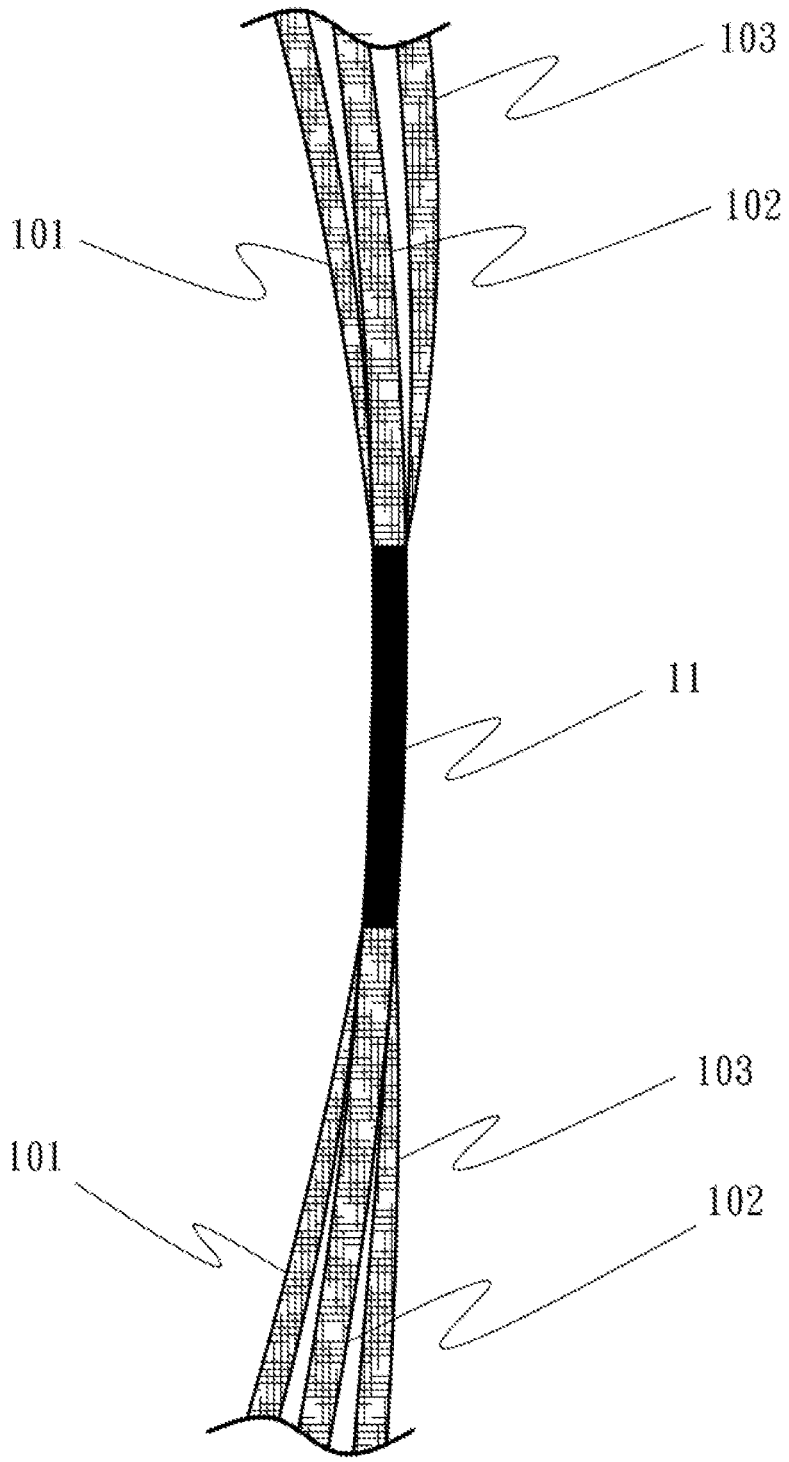
FIG. 2 is a cross-section view of a mask with sound transmission structure.

As shown in FIG. 1, a mask (1) with a mask body (10) of three-layered non-woven cloth in PE (Polyethylene) fiber is taken to be seal-pressed with an ultrasonic sealing machine on the lower part more to the right of the mask. The tiny holes of PE fiber are seal-pressed and hot-melted at the seal-pressing point to mutually bond from dissolving due to the high temperature so as to form a sound transmission structure (11). The sound transmission structure (11) is a square with a diameter of 0.5~2 centimeter. The cross-section of the mask is shown in FIG. 2, the internal mask layer (101), intermediate mask layer (102), external mask layer (103) are bonded together and have no tiny holes due to the seal-pressing and hot-melting on the sound transmission structure (11), and the seal-pressing point can be selected to appear transparent but the color thereof is not limited to a transparent color; apart from PE, the material of the mask can also be substituted by other artificial fibers such as PU (Polyurethanes), PET (polyethylene terephthalate), PP (Polypropylene), PB (Polybutene), and PS (Polystyrene).

Use effects of the mask: testing the sound transmission effect when wearing a mask; holding a mobile phone on the right hand and the sound can be clearly heard from the user through the phone, and the sound is also clear when holding the phone on the left hand. It can be known from the test that there are no tiny holes at the seal-pressing point the mask to absorb the sound, therefore the sound can be transmitted effectively.

Embodiment 4

A Mask Capable of Transmitting Sound Having the Function of Sound Expansion

Figure 3:
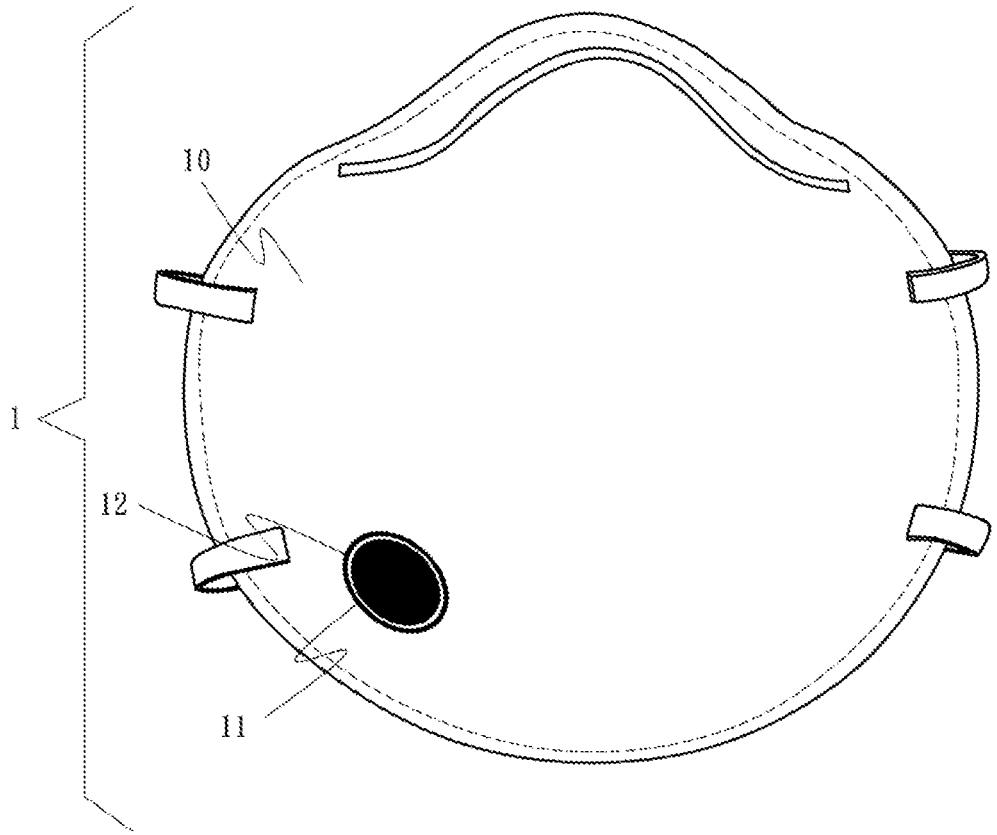
FIG. 3 is a view of a mask with sound transmission structure of speaker edge.
Figure 4:
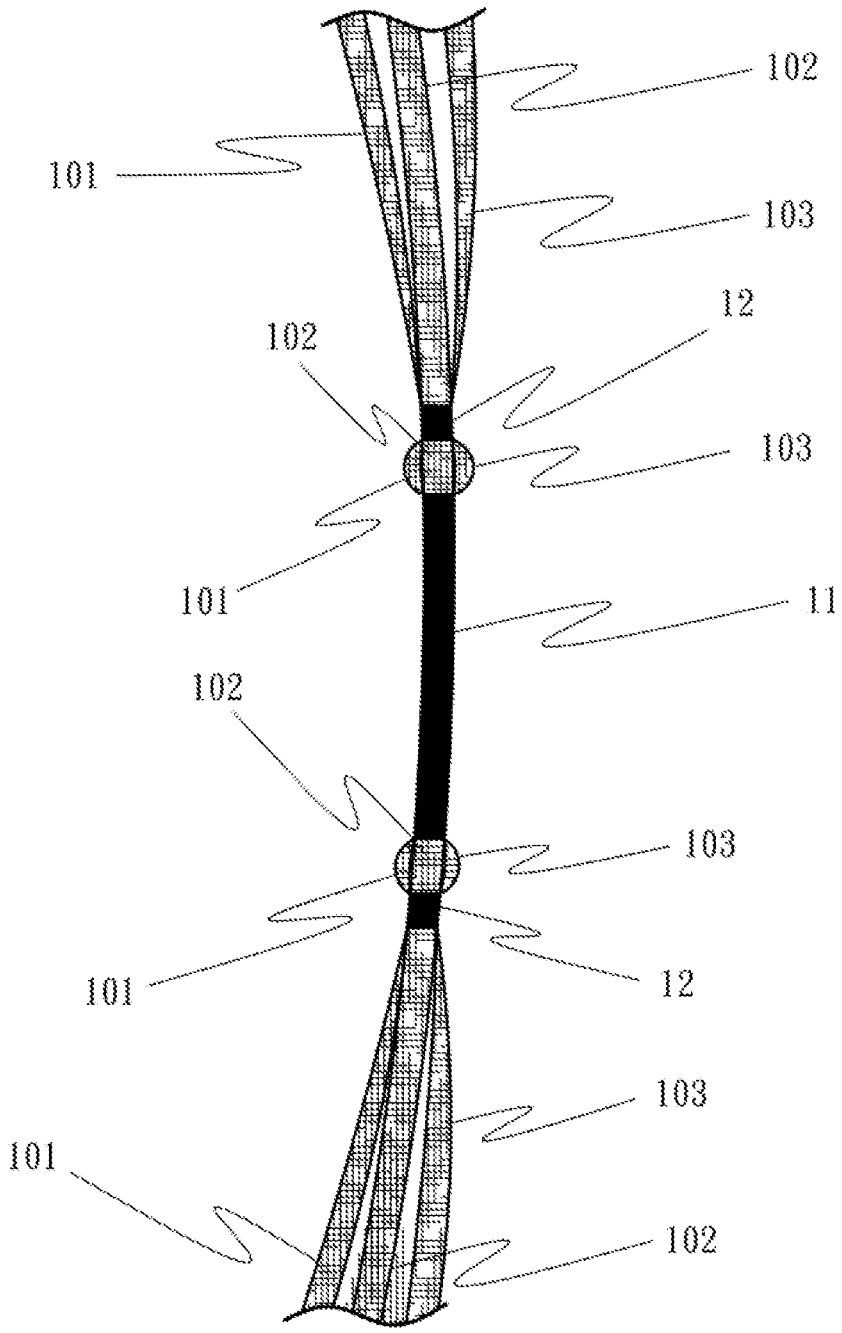
FIG. 4 is a cross-section view of a mask with sound transmission structure of speaker edge.

As shown in FIG. 3, a mask (1) with a mask body (10) of single-layered non-woven cloth in PET fiber is taken to be seal-pressed with an ultrasonic sealing machine on the lower part more to the right of the mask. The seal-pressing point (11) is seal-pressed and hot-melted to mutually bond the tiny holes of the PET fiber from dissolving due to the high temperature. At the seal-pressing point a sound transmission structure (11) in a round form with a diameter of 0.5~2 centimeter is formed and a ring-shaped structure outside the circle forms a speaker edge (12), the diameter, length and width of the speaker edge being 0.6~3 centimeter. The cross-section of the mask is shown in FIG. 4, the internal mask layer (101), intermediate mask layer (102), external mask layer (103) are bonded together and have no tiny holes due to the seal-pressing and hot-melting on the sound transmission structure (11) and the speaker edge (12), and the seal-pressing point can be selected to appear transparent but the color thereof is not limited to a transparent color; apart from PET, the material of the mask can also be substituted by other artificial fibers such as PU (Polyurethanes), PE (Polyethylene), PP (Polypropylene), PB (Polybutene), and PS (Polystyrene).

Use effects of the mask: testing the sound transmission effect when wearing a mask; holding a mobile phone on the right hand and the sound can be clearly heard from the user through the phone, but the volume on the left where there is no sound film becomes smaller while the sound distortion exists. It can be known from the test that there are no tiny holes at the seal-pressing point of the mask to absorb the sound, therefore the sound can be transmitted effectively, and that the speaker edge outside the sound transmission structure increases the power and elasticity of the synthetic wave of the intermediate sound transmission structure, thus showing the effect of sound expansion.

The above-mentioned detailed description aims to specifically illustrate the practicable embodiments of the present invention, but the embodiments are not for limiting the patent scope of the present invention and all equivalents or modifications made without departing from the technical spirit of the present invention shall be contained within the patent scope of the present invention.

The plentiful effects above-mentioned meet the lawful patent requirements for novelty and inventiveness. The inventor files an application according to law and earnestly urge honorable Office to approve the patent application of the present invention as an encouragement thereof.

What is claimed is:

1. A breathable mask capable of transmitting sound, wherein a body of the mask comprises a breathable structure having a plurality of breathable holes, a sound transmission structure without the breathable holes, and a speaker edge without the breathable holes, in which the speaker edge is a circle structure outside the sound transmission structure;

wherein the sound transmission structure is prepared as follows:

selecting a sound transmission area on the breathable mask and seal-pressing and hot-melting the inner and outer part of the mask, then melting the plurality of breathable holes of the sound transmission area into a non-porous structure through the seal-pressing and hot-melting process;

wherein the speaker edge is prepared as follows:

selecting a sound expansion area at a spaced-periphery of the sound transmission structure from the breathable mask, where the spaced-periphery is spaced apart from an outer boundary of the sound transmission structure;

and then seal-pressing and hot-melting an inner and outer part of the mask to melt the plurality of breathable holes of the sound transmission area into a non-porous structure;

an annular section is formed between the outer boundary of the sound transmission structure and the speaker edge, wherein the annular section having the breathable structure with the plurality of breathable holes;

wherein the speaker edge is concentric with the sound transmission structure;

wherein a number of the speaker edge is one or more than one, wherein a diameter of the sound transmission area is 0.5-2 centimeter.

2. The breathable mask capable of transmitting sound having sound expansion function according to claim 1, wherein the breathable mask is a structure with one layer, two layers, three layers or more than three layers; wherein each layer is melted to bond mutually by the seal-pressing and hot-melting.

3. The breathable mask capable of transmitting sound having sound expansion function according to claim 1, wherein a material of the breathable mask is an artificial fiber.

4. The breathable mask capable of transmitting sound having sound expansion function according to claim 3, wherein the artificial fiber is selected from a group consisting of PU (Polyurethanes), PE (Polyethylene), PET (polyethylene terephthalate), PP (Polypropylene), PB (Polybutene), and PS (Polystyrene).

5. The breathable mask capable of transmitting sound having sound expansion function according to claim 1, a non-woven cloth with a designated color is added to any layer of the breathable mask and the designated color can be presented after the seal-pressing and hot-melting process.

* * * * *